US006740828B1

(12) United States Patent
Dacal et al.

(10) Patent No.: US 6,740,828 B1
(45) Date of Patent: May 25, 2004

(54) ARM AND SAFETY SWITCH

(76) Inventors: Claudio R. Dacal, 66 Thackeray Rd., Oakland, NJ (US) 07436; Stephen J. Gross, 106 Lincoln Park Rd., Pequannock, NJ (US) 07440

( * ) Notice: Subject to any disclaimer, the term of this patent is extended or adjusted under 35 U.S.C. 154(b) by 0 days.

(21) Appl. No.: 10/636,472

(22) Filed: Aug. 8, 2003

(51) Int. Cl.[7] ..... H01H 35/34
(52) U.S. Cl. ..... 200/83 J; 200/83 P
(58) Field of Search ..... 220/52 R, 81 R, 220/83 R, 83 D, 83 J, 83 P, 83 T

(56) References Cited

U.S. PATENT DOCUMENTS

| | | | | | |
|---|---|---|---|---|---|
| 2,704,551 | A | | 3/1955 | Ralston | 137/494 |
| 2,824,919 | A | | 2/1958 | Davis | 200/83 |
| 3,093,716 | A | * | 6/1963 | Horowitz | 200/83 P |
| 3,330,925 | A | | 7/1967 | Andrew | 200/83 |
| 3,332,642 | A | * | 7/1967 | Halling | 244/3.15 |
| 3,378,656 | A | | 4/1968 | Johnson | 200/83 |
| 3,436,502 | A | | 4/1969 | Egli | 200/83 |
| 3,573,410 | A | * | 4/1971 | Budzich et al. | 200/83 P |
| 4,214,137 | A | | 7/1980 | Hartley | 200/83 |
| 4,243,858 | A | | 1/1981 | Place | 200/83 |
| 4,330,695 | A | | 5/1982 | Poling | 200/83 |
| 4,351,105 | A | | 9/1982 | Poling | 29/622 |
| 4,456,801 | A | | 6/1984 | Lauritsen et al. | 200/83 |
| 4,593,166 | A | * | 6/1986 | Hirota et al. | 200/83 J |
| 4,694,127 | A | | 9/1987 | Amuda | 200/83 |
| 4,827,094 | A | | 5/1989 | Tanaka et al. | 200/83 |
| 4,827,095 | A | | 5/1989 | Clark et al. | 200/83 |
| 4,948,931 | A | | 8/1990 | Nixon et al. | 200/83 |
| 5,015,808 | A | | 5/1991 | Czarn et al. | 200/83 |
| 5,121,094 | A | * | 6/1992 | Ting et al. | 337/2 |
| 5,132,500 | A | | 7/1992 | Clew | 200/83 |
| 5,149,927 | A | | 9/1992 | Stahly | 200/83 |
| 5,252,792 | A | | 10/1993 | Joyce | 200/83 |
| 5,285,648 | A | * | 2/1994 | Bessler | 62/129 |
| 5,438,173 | A | * | 8/1995 | Rudoy et al. | 200/52 R |
| 5,524,333 | A | | 6/1996 | Hogue et al. | 29/593 |
| 5,661,278 | A | | 8/1997 | Atkinson et al. | 200/83 |
| 5,808,255 | A | | 9/1998 | Sehlhorst et al. | 200/83 |
| 5,814,779 | A | | 9/1998 | Verras et al. | 200/83 |
| 5,932,857 | A | | 8/1999 | Stander et al. | 200/83 |
| 6,267,418 | B1 | | 7/2001 | Hogue et al. | 285/331 |
| 6,346,681 | B1 | | 2/2002 | Joyce et al. | 200/835 |

OTHER PUBLICATIONS

Northeast Controls, Inc. found at http://www.nciweb.net/differen.htm.

Dwyer—Introduction to Precision Low Range Differential Pressure Switches found at http://216.185.34/htdocs/pressure/SwitchIntroduction.cfm.

Sigma–Netics—703–U Type A/AA found at http://www.sigma–netics.com/703ua.htm.

* cited by examiner

*Primary Examiner*—Michael A. Friedhofer
(74) *Attorney, Agent, or Firm*—Ernest D. Buff and Associates, LLC; Ernest D. Buff; Dove Norosimhon

(57) ABSTRACT

An arm and safety switch for ammunition rounds, such as a 120 mm multipurpose tank round, senses launch detonation pressure. The switch will not arm the projectile if the pressure detected is less than or equal to a first predetermined pressure characteristic of a misfire, and will arm if the detected pressure is greater than or equal to a second predetermined pressure characteristic of a successful launch. An efficient, reliable method and mechanism operate to discriminate between successful and unsuccessful projectile launch and use that information to arm or not arm the projectile.

5 Claims, 2 Drawing Sheets

ARM AND SAFETY SWITCH

BACKGROUND OF THE INVENTION

1. Field of the Invention

The present invention relates to pressure responsive, electrical switches; and more particularly to an arming and safety switch within an ammunition round that arms the projectile's explosive payload upon sensing a predetermined pressure from the projectile's propellant, but will not arm the projectile if a misfire occurs.

2. Description of the Prior Art

Safety devices and arming devices have been utilized on ammunition to prevent inadvertent detonations. For example, projectiles such as grenades, rockets, large caliber ordnance, and aircraft carried bombs have utilized various arming mechanisms. These arming mechanisms are adapted to arm the explosive device upon sensing appropriate accelerations and decelerations that are characteristic of launch and impact with an intended target.

Some safe and arm devices are purely mechanical in nature, relying upon centrifugal effects of the spinning projectile. Typical safe and arm mechanical devices are disclosed by U.S. Pat. Nos. 3,742,854; 4,796,532; and 4,869,172. Other safe and arm devices have been designed to electronically sense launch, velocity, and impact, and in so doing, arm and detonate the main explosive charge. U.S. Pat. No. 3,359,904 to Nerheim, discloses a fuze, which utilizes a piezoelectric crystal compressed by the set back forces on launch to produce a charge, which is stored in a capacitor. Upon impact, a second piezoelectric crystal is compressed. A charge is thereby generated to actuate an electronic switch, thereby discharging the capacitor, which had been previously charged upon launch.

Another electronic device, described in U.S. Pat. No. 3,653,324 to Ferlani et al, utilizes two transducers to sense a peculiar signature, which results from a projectile launch. The first transducer is a set back sensing piezoelectric crystal and the second is a barrel exit sensing transducer. Upon receipt of a signal proportional to the correct launch acceleration followed by a signal representative of barrel exit, a switch is closed to actuate a separate arming device.

U.S. Pat. No. 3,808,975, discloses a piezoelectric crystal powered fuze circuit using a pair of back to back piezoelectric crystal cells. The cells develop a potential upon acceleration of the projectile and then develop a reverse potential upon relaxation of the acceleration when the projectile emerges from the firing weapon. Thus, the piezoelectric cells sense projectile launch and muzzle exit to arm the device. A third piezoelectric cell or element is utilized to sense impact and detonate the device.

U.S. Pat. No. 3,850,102, to Mauro discloses a single piezoelectric crystal, which is adapted to perform three functions. First, the crystal is compressed in one direction by the set back force of launch to produce a first voltage signal. During flight it senses the air impinging upon the launched projectile, thus generating a second lower voltage signal. Finally, it is compressed in the opposite direction upon impact to trigger the projectile detonation.

U.S. Pat. No. 3,967,555 issued To Gollick et al discloses a battery operated piezoelectric fuze, which has a piezoelectric element to convert the mechanical shock of impact and into a detonator ignition signal. An arrangement of two diodes and a thyristor prevent detonator actuation if the shock wave produced upon impingement of the fuze is less than a threshold value. The arrangement operates to prevent unintended ignition. It also provides ignition without there having been a response by the piezoelectric element, such as upon impact. In this case, the piezoelectric element merely controls the switch between the battery power supply and the detonator.

In U.S. Pat. No. 4,723,087, a piezoelectric polymer ring is utilized to sense impact at virtually any angle and generate a voltage to ignite the detonating charge.

Another device, disclosed in U.S. Pat. No. 4,739,705 to Hudson et al, requires power from a missile battery. The accelerations of the missile due to an expulsion motor and a boost motor are sensed. In addition, Hall sensors are utilized in conjunction with an inertial wheel to provide a signal proportional to velocity and distance. After a predetermined distance, the signal causes the detonator to be armed and aligned with the warhead stem.

Another example in which a piezoelectric crystal is used is disclosed in U.S. Pat. No. 4,848,234 to Farace et al. In this patent, a piezoelectric crystal is utilized to sense the spin rate of a projectile.

Snap-action pressure and electrical switches are known in the literature.

U.S. Pat. No. 3,330,925 to Andrew et al. discloses a snap-acting pressure switch. When fluid pressure exceeds a particular threshold value, the electrical switch snaps from a first electrical condition to a second electrical condition. Closure is accomplished by the snap action movement of a double diaphragm snap-acting cartridge, supported by a spring. U.S. Pat. No. 3,436,502 to Egli discloses an electric pressure-control snap switch. A snap-action diaphragm switch for controlling pressure of liquids or gases has at least one contact spring, controlled by the pressure-activated diaphragm through an intermediate lever. The diaphragm is acted upon by an adjusting spring as well as by a compensating spring that acts in a different direction to produce superimposed torques.

U.S. Pat. No. 3,573,410 to Budzich discloses a snap action pressure sensitive switch with snap disc resiliently supported between legs of a terminal. One switch contact is supported by an elongated bi-stable snap element and the snap element is mounted on cantilever springs. The snap element bends in single mode urging ends of the snap element to come together. While U.S. Pat. No. 4,214,137 to Hartley discloses a pressure switch with snap element. A pressure switch has a housing and a first contact mounted in it. A pressure responsive member is mounted in the housing for moving a second contact into and out of engagement with the first contact. U.S. Pat. No. 4,330,695 to Poling discloses a control device. This control device has a snap-action member that operates a switch device switching from one conductive mode to the other. An actuator between the snap-action member and the switch device, and a spring are provided and methods of assembly are described.

While some of the foregoing references arm the projectile and others disclose snap-action switch members, they neither address nor solve a serious problem, namely, the event of a projectile misfire. A misfire may result in the projectile having insufficient velocity to exit a safe zone around the launcher and cause the projectile to inadvertently fall on friendly forces. There remains a need in the art for a reliable, inexpensive switch system that senses a successful projectile launch and discriminates between successful and unsuccessful launches in the arming of an ammunition round.

SUMMARY OF THE INVENTION

The invention provides an arm and safety switch for an ammunition round such as a 120 mm multipurpose tank round. The switch senses launch detonation pressure. Advantageously, the switch will not arm the projectile if the pressure detected is less than or equal to a first predetermined pressure characteristic of a misfire; but will arm the projectile if the detected pressure is greater than the first predetermined pressure and less than or equal to a second predetermined pressure characteristic of a successful launch. The invention further provides a method for arming ammunition rounds by detecting launch detonation pressure and using that information to arm or not arm the projectile.

Generally stated, the switch has a housing with an open first end and an open second end. A diaphragm covers the open first end of the housing. An actuator has a first and second end. The first end of the actuator is positioned perpendicular to the diaphragm and is located at a first predefined distance therefrom. An electrically conductive pad is fixed to the second end of the actuator. A first firing pin points at the electrically conductive pad. A second firing pin positioned parallel to the first firing pin also points at the electrically conductive pad. A non-conductive plug is used for receiving the firing pins and securing the firing pins within the second open-end of the housing. A bi-stable snap actuating disc is fixed within the housing. The disc has an opening in its center for receiving and fixing to the actuator. In a first stable position of the disc, the conductive pad is located at a second predefined distance from the firing pins. The disc also has a second stable position, in which the electrically conductive pad is in contact with the firing pins. A launch detonation pressure less than or equal to a first predetermined pressure may cause the diaphragm to deflect beyond the first predefined distance, but not enough to push the actuator and associated snap disc beyond the snap-over point. On the other hand, a launch detonation pressure greater than the first predefined pressure will cause the diaphragm to deflect beyond the first predefined distance, and to in-turn push the actuator and associated snap disc beyond the snap-over point. This causes the bi-stable snap actuating disc to deflect into its second position, causing the electrically conducting pad to traverse the second predefined distance and to come in contact with the firing pins, thereby arming the ammunition. Preferably, springs are used to upload the firing pins ensuring contact between the electrically conducting pad and firing pins even if the pad contacts the pin at an angle.

Further, the invention provides a method of arming a launched ammunition round. In operation of the method, a diaphragm is deflected in response to the launch detonation pressure. The deflection is controlled to provide a diaphragm movement range, so that the deflection proceeds for a first predetermined distance when the diaphragm is subjected to a launch detonation pressure ranging up to a first predetermined pressure. An actuator moves in response to the deflection of the diaphragm when the launch detonation pressure is equal to or greater than the first predetermined pressure. As a consequence of the moving actuator, a bi-stable snap actuating disc is deflected. The bi-stable snap actuating disc is operationally connected to the actuator, and is normally disposed in a first stable position. A second predetermined distance is provided for the bi-stable snap actuating disc to deflect into when the disc is subjected to a launch detonation pressure that is between the first predetermined pressure and a second predetermined pressure. When the launch detonation pressure is greater than the first predetermined pressure and less than or equal to the second predetermined pressure, the bi-stable snap actuating disc "snaps" into its second stable position. Disposition of the bi-stable snap acting disc in the second stable position operates to connect an electrically conductive pad, attached to the actuator, to two firing pins. This causes the firing pins to become electrically connected and thereby arms the ammunition round.

Advantageously, use of the arm and safety switch of this invention includes, in combination, the following features: (i) use of a diaphragm to move an actuator in response to launch detonation pressure; (ii) use of a bi-stable snap action disc that is driven beyond its snapping point when the detonation pressure at launch exceeds a first predetermined pressure and is less than or equal to a second predetermined pressure, whereupon forces provided by such detonation pressure cause the diaphragm to deflect enough to impact on the actuator and accompanying electrically conductive pad, providing sufficient force to deflect the bi-stable snap disc beyond its snap point so that a change in direction of force occurs, the change in force direction of the bi-stable snap disc propelling the actuator and accompanying electrically conductive pad into contact with the firing pins, creating a closed circuit and allowing an electrical signal to activate the fuze in the projectile, the bi-stable snap action disc structure being operative to assure the effective arming of a projectile launched at pressures sufficient to cause it to fall within the target zone; (iii) use of a gap between the electrically conductive pad and firing pins, preventing a closed circuit condition when launch detonation pressures are below a first predetermined pressure since the bi-stable snap action disc, and accompanying electrically conductive pad, do not have enough stroke to overcome said gap to come into contact with the firing pins, thereby precluding arming of a projectile launched at detonation pressure likely to cause it to land in a safety area, the gap structure being operative at such lower launch pressure, so that the snapped disc is not loaded beyond the snapping point, electrical contact between the electrically conductive pad and the firing pins is not established, and arming of the projectile is precluded; (iv) providing a safety margin sensed by the switch, thereby assuring that a misfired projectile, namely, a projectile fired with a barrel detonation pressure below a first predetermined pressure, will land within a "safety area" without being armed, and that the projectile is armed when the switch senses barrel detonation pressure exceeding second predetermined pressure, assuring its detonation upon landing within a "reliability area"; and (v) use of spring loaded firing pins to ensure a closed circuit condition when the actuator's electrically conductive pad contacts the firing pins, the spring loaded condition of the firing pins being operative to assure that both pins perform as though they were assembled exactly on the same plane, so that when the electrically conductive pad on the actuator contacts the first pin, it will not stop, but continues further, contacting the second pin, causing the actuator movement to continue until maximum deflection of the snap disc is achieved.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF THE PREFERRED EMBODIMENTS

Ammunition rounds, such as 120 mm multipurpose tank rounds, are projectile shells having the warhead and fuze in the projectile portion of the round. The fuze sets off the explosive warhead under certain conditions. The present invention provides for a pressure switch having a diaphragm and firing pins placed in the trailing wall of the projectile, such that electrical leads to the firing pins connect to the fuze, while the diaphragm faces the propellant charge in the shell casing.

Figure 1:
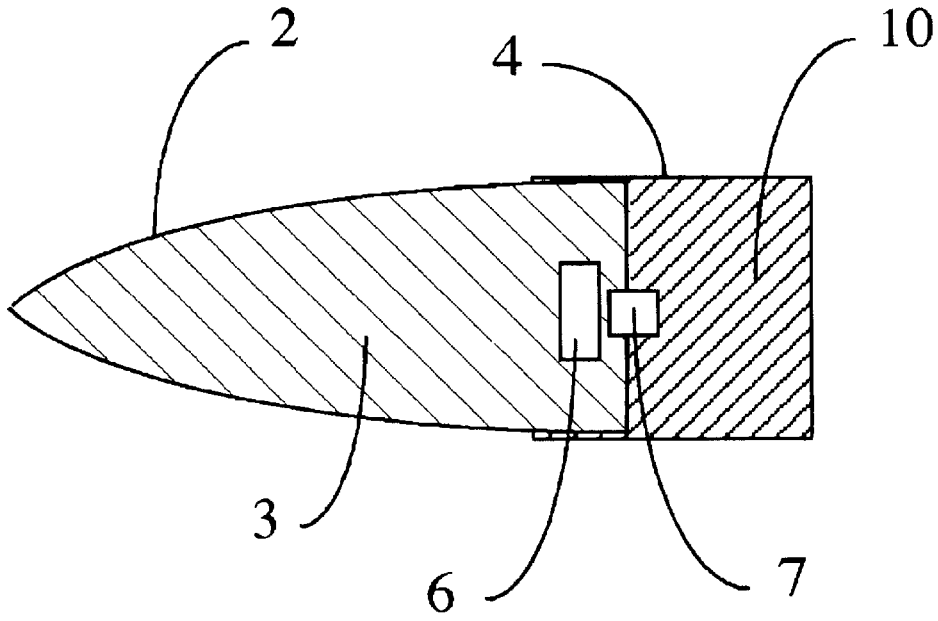
FIG. 1 is a cross-sectional view of the arm and safety switch of the present invention.

Referring to FIG. 1, there is shown a schematic illustration of an arm and safety switch within an ammunition round 1. Depiction of the arm and safety switch by FIG. 1 is for illustration purposes only; is not intended to represent accurate switch dimensions or component placements. The projectile 2 contains an explosive warhead 3 and a fuze 6. Shell casing 4 contains propellant 10. The arm and safety switch 7 of this invention is electrically connected to the fuze 6 and placed such that it is exposed to chamber pressure resulting from detonation of propellant 10.

Figure 2:
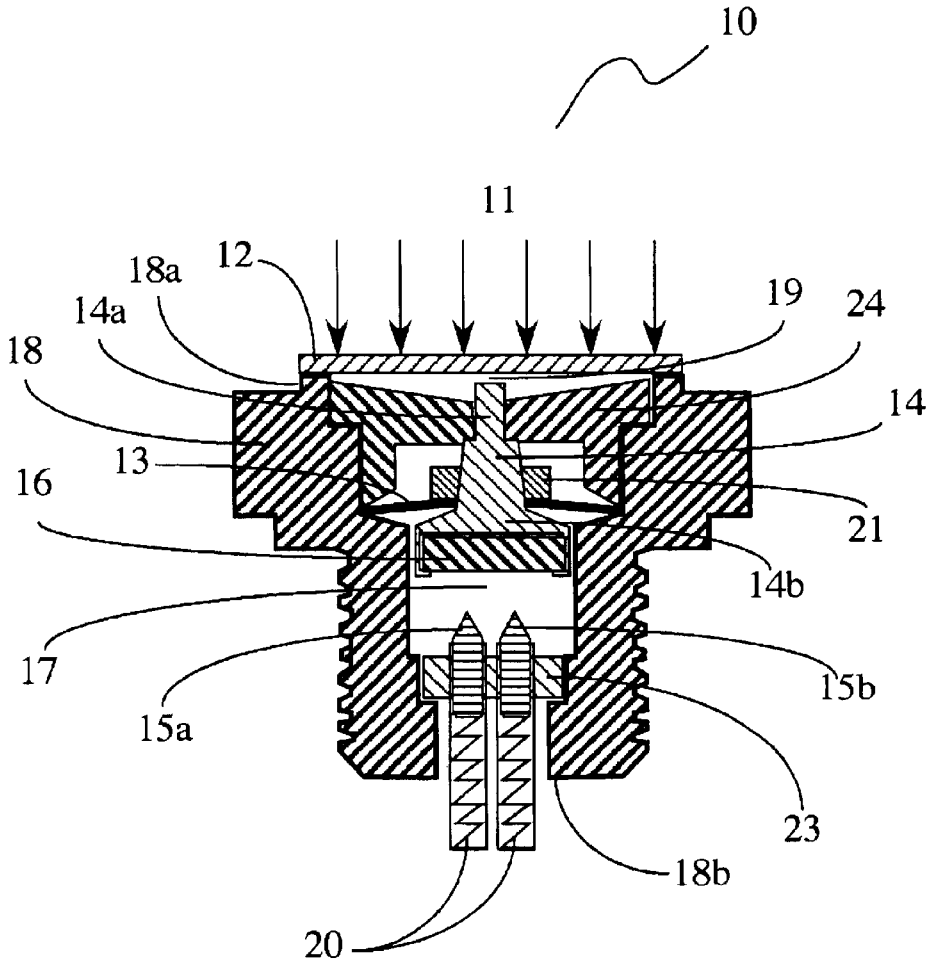
FIG. 2 is a block diaphragm of the method of the present invention for using launch detonation pressure to arm an ammunition round.

Referring to FIG. 2, there is shown a cross-sectional view of an arm and safety switch. The arm and safety switch is preferably threaded into the projectile in such a way that diaphragm 12 is exposed to chamber pressure resulting from detonation of propellant 10. It incorporates a mechanism that allows contact with firing pins 15*a* and 15*b* only when specific conditions are met. The detonation pressure when the projectile is in the gun barrel is applied along 11. Housing 18 has an open first end 18*a* and an open second end 18*b*. A diaphragm 12 covers the open first end 18*a* of the housing 18 and deflects under launch detonation pressure 11. Preferably, diaphragm 12 is welded to open-end 18*a* of housing 18. Actuator 14 has a first end 14*a* and second end 14*b*, wherein the first end 14*a* of the actuator 14 is positioned perpendicular to the diaphragm 12 and at a first predefined distance 19 from the diaphragm. An electrically conductive pad 16 is fixed to the second end 14*b* of the actuator 14. A first firing pin 15*a* points at the electrically conductive pad 16, and a second firing pin 15*b* positioned parallel to the first firing pin 15*a* also points at the electrically conductive pad 16. The firing pins are electrically connected to the fuze within the shell. A non-conductive plug 23 has openings for receiving the firing pins 15*a* and 15*b* and securing the firing pins into the second open-end 18*b* of the housing 18. A bi-stable snap actuating disc 13 is fixed within the housing 18 around its circumference. The disc 13 has an opening in its center for receiving and fixing to the actuator 14. Disc 13 has a first stable position whereby the conductive pad is located at a second predefined distance 17 from the firing pins 15*a* and 15*b*, and a second stable position whereby the electrically conductive pad 16 is in contact with the firing pins 15*a* and 15*b*. Bi-stable snap actuating disc 13 can be constructed in the manner described by U.S. Pat. No. 5,269,499. Actuator 14 is held within disc 13 by retaining collar 21 or alternatively using a force fit. Before firing the projectile, the switch 10 is in the open position since bi-stable snap acting disc 13 is in its first stable position. Optionally, containment ring 24 is used to channel actuator 14, retain the outer edge of disc 13, and control the amount of deflection of diaphragm 12.

Preferably, firing pins 15*a* and 15*b* are spring loaded using springs 20, since it is difficult to have both pins assembled exactly on the same plane or the actuator may move down at a slight angle. Therefore, when the electrically conductive pad 16 attached to the actuator 14 contacts the first pin, it will not stop, but continues further, contacting the second pin. With this preferred construction, the actuator 16 will continue to move until maximum deflection of the snap disc 13 is achieved.

In operation, a launch detonation pressure 11 less than or equal to a first predetermined pressure may cause the diaphragm 10 to deflect beyond the first predefined distance 19, but not enough to push the actuator 14 and accompanying bi-stable snap acting disc 13 beyond the snap-over point of the bi-stable snap acting disc 13 but a launch detonation pressure 11 greater than the first predetermined pressure and equal to or less than the second predefined pressure will cause the diaphragm to deflect beyond the first predefined distance 19 and to in-turn push the actuator 14 and accompanying bi-stable snap acting disc 13 beyond the snap-over point of the bi-stable snap acting disc 13, causing the bi-stable snap actuating disc 13 to deflect into its second stable position allowing the electrically conducting pad 16 to traverse the second predefined distance 17 and to come in contact with the firing pins 15*a* and 15*b* thus arming the ammunition.

Once the snap point of the disc 13 is reached, the disc 13 transitions from its first stable position to its second stable position and carries the actuator 14 further until it stops when conducting pad 16 is in contact with the firing pins 15*a* and 15*b*. The snap disc 13 has sufficient force to maintain electrical contact between conducting pad 16 and the firing pins 15*a* and 15*b* during vibration, setback acceleration, balloting, spinning, and deceleration due to air resistance, etc. Maintaining electrical contact means the switch 10 is in the closed position and thus causes the fuze in the projectile to arm. Arming of the projectile is carried out in accordance with three main criteria. First, the switch must not operate to arm the projectile below the first predetermined pressure, 5000 psi for example. Since projectiles launched with pressures below the first predetermined pressure are misfires and likely to land within a "safety area" short of the intended target, they must not be armed. Second, the switch may be operable to arm the projectile at pressures between the first predetermined pressure and the second predetermined pressure, 30,000 psi for example, since projectiles launched with pressures within the first predetermined pressure-and the second predetermined pressure are likely to land within an "area of indifference." In this case, an armed projectile raises no undue concern. Third, the switch must always arm the projectile at pressures above the second predetermined pressure, since projectiles launched with such pressures invariably fall into the "reliability area", within which they are expected to be armed. Accordingly, for pressures above the second predetermined pressure, the switch must change to a normally closed electrical condition and stay in that mode for the duration of the flight, or a minimum amount of time as required by the fuze manufacturer.

Although a typical application does not require the switch to change state from normally open to normally closed until the pressure reaches a second predetermined pressure, it is possible that due to tolerances in material characteristics and dimensions, the snap disc could snap over at pressures between first predetermined pressure and second predetermined pressure. If this condition occurs, the setback acceleration induced force will tend to push the snap disc back to its original shape. However, this event would happen during the launch phase, and pressure would be building up behind the diaphragm causing it to keep expanding. As the diaphragm further expands, it would prevent the snap disc from returning to its original state. In other words, the diaphragm would act as a stop when pressures are above first predetermined pressure. Therefore, once the setback acceleration induced force begins to dissipate and falls below the snap disc's snap force as the projectile exits the muzzle, the snap disc is free to move towards the firing pins, allowing the actuator and accompanying electrically conductive pad to create a normally closed condition as it contacts the firing pins.

Further performance advantages and cost reducing features include: 1. Use of a diaphragm to sense launch detonation pressure to move an actuator. 2. Use of a bi-stable snap action disc that is driven beyond its snapping point when the launch detonation pressure exceeds the first predetermined pressure, whereupon forces provided by such detonation pressure cause the diaphragm to deflect enough to impact on the actuator with accompanying electrical pad, thus providing sufficient force to deflect the bi-stable snap disc beyond its snap point whereby a change in direction of force occurs. The change in force direction of the bi-stable snap disc propels the actuator and accompanying electrically conductive pad into contact with the firing pins, creating a closed circuit and allowing an electrical signal to activate the fuze in the projectile. With this structure, arming of a projectile launched at pressures sufficient to cause it to fall within the target zone is assured. 3. Use of a first predefined distance between the diaphragm and the actuator so that pressures at or below a first predefined pressure do not cause the actuator to move enough to allow the switch to arm the projectile, which is likely to fall within a safety zone. 4. Use of a second predetermined distance between the electrically conductive pad and firing pins, whereby launch detonation pressures that fall short of a first predetermined pressure ensures that movement of a bi-stable snap action disc can occur without arming the projectile. At such lower launch pressures, the diaphragm's deflection is insufficient and the bi-stable snap disc is not loaded beyond the snapping point. Electrical contact between the electrical pad and the firing pins is not established, preventing the projectile from arming. 4. Providing a safety margin sensed by the switch, thereby assuring that a projectile launched with insufficient energy to reach its intended target, namely, a projectile fired with a barrel detonation pressure below the first predetermined pressure, will land within a "safety area" with the fuze in a "not-armed" mode. 5) Use of spring loaded firing pins to ensure a closed circuit condition when the actuator's electrically conductive pad contacts said firing pins. The firing pins are spring loaded since it is impossible to have both pins assembled exactly on the same plane. Therefore, when the electrically conductive pad on the actuator contacts the first pin, it will not stop, but continues further, contacting the second pin. The actuator will continue to move until maximum deflection of the snap disc is achieved.

The invention has been described in detail with particular reference to the preferred embodiments thereof, but it will be understood that additional variations and modifications may suggest themselves to one skilled in the art, all falling within the scope of the invention as defined by the subjoined claims.

What is claimed is:

1. An arm and safety switch for an ammunition round, comprising:

(a) a housing having an open first end and an open second end;

(b) a diaphragm covering said open first end of said housing;

(c) an actuator having a first end and a second end, wherein said first end of said actuator is positioned perpendicular to said diaphragm and at a first predefined distance from said diaphragm;

(d) an electrically conductive pad fixed to said second end of said actuator;

(e) a first firing pin pointing at said electrically conductive pad;

(f) a second firing pin positioned parallel to said first firing pin and pointing at said electrically conductive pad;

(g) a non-conductive plug for receiving said firing pins and securing said firing pins into said second open-end of said housing; and (h) a bi-stable snap actuating disc fixed within said housing, said disc having an opening in the center for receiving and fixing to said actuator, said disc having a first stable position whereby said conductive pad is a second predefined distance from said firing pins and a second stable position whereby said electrically conductive pad is in contact with said firing pins;

whereby a launch detonation pressure less than or equal to a first predetermined pressure will cause said diaphragm to deflect within said first predefined distance, the deflection being insufficient to push said actuator and associated bi-stable snap acting disc enough to reach the snap-over point, so that said bi-stable snap acting disc is prevented from reaching the second stable position, thus precluding electrical contact between the conductive pad and firing pins, and a launch detonation pressure of at least a second predefined pressure will cause said diaphragm to deflect beyond said first predefined distance and to in-turn push said actuator, thus causing said bi-stable snap actuating disc to deflect into the second stable position causing said electrically conducting pad to come in contact with said firing pins to arm said ammunition.

2. An arm and safety switch as recited by claim 1, wherein said first and second firing pins are provided with uploading springs, thereby ensuring that said firing pins both make contact with said electrically conducting pad even when said pad contacts said pins at an angle.

3. An arm and safety switch as recited by claim 1, wherein said second end of said housing is threaded, thereby providing means for securing said switch within said ammunition.

4. An arm and safety switch as recited by claim 1, wherein said diaphragm is welded to said first open-end of said housing.

5. A method for arming a launched ammunition round, comprising the steps of:

(a) deflecting a diaphragm in response to a launch detonation pressure;

(b) providing a first predetermined distance for said diaphragm to deflect into when said diaphragm is subjected to a launch detonation pressure up to a first predetermined pressure;

(c) moving an actuator in response to deflection of said diaphragm when said launch detonation pressure is equal to or greater than said first predetermined pressure;

(d) deflecting a bi-stable snap actuating disc, operably connected to said actuator, said disc being in its first stable position;

(e) providing a second predetermined distance for said bi-stable snap actuating disc to deflect into when said disc is subjected to a launch detonation pressure that is between said first predetermined pressure and a second predetermined pressure;

(f) snapping said bi-stable snap actuating disc into its second stable position when said launch detonation pressure is greater than the first predetermined pressure and equal to or less than said second predetermined pressure; and (g) connecting an electrically conductive pad, attached to said actuator, to a plurality of firing pins, whereby said firing pins become electrically connected, thereby arming said ammunition round.

* * * * *